US005966824A

United States Patent [19]

Vázquez

[11] Patent Number: 5,966,824

[45] Date of Patent: Oct. 19, 1999

[54] SEWING AUXILIARY TOOL

[75] Inventor: Concepción Pérez Vázquez, Moca, Puerto Rico

[73] Assignee: Commonwealth of Puerto Rico, San Juan, Puerto Rico

[21] Appl. No.: 08/867,061

[22] Filed: Jun. 2, 1997

[51] Int. Cl.[6] ..... A41H 1/00; G01B 3/14

[52] U.S. Cl. ..... 33/11; 33/563

[58] Field of Search ..... 33/11, 476, 494, 33/16, 12, 17 R, 492, 561.1, 562, 563, 565, 566

[56] References Cited

U.S. PATENT DOCUMENTS

| | | | |
|---|---|---|---|
| 242,696 | 6/1881 | Robinson . | |
| 503,741 | 8/1893 | Faestel | 33/11 |
| 613,095 | 10/1898 | Van Dame . | |
| 616,493 | 12/1898 | Richardson et al. . | |
| 662,620 | 11/1900 | Goff | 33/11 |
| 717,284 | 12/1902 | Ryan . | |
| 731,115 | 6/1903 | Morgan | 33/11 |
| 819,438 | 5/1906 | Jones | 33/11 |
| 875,554 | 12/1907 | Pelton | 33/11 |
| 909,023 | 1/1909 | Ratner . | |
| 910,203 | 1/1909 | Johnson . | |
| 1,108,040 | 8/1914 | Watters . | |
| 1,158,425 | 11/1915 | Barnes . | |
| 1,200,035 | 10/1916 | Schmit . | |
| 1,204,900 | 11/1916 | Picken | 33/11 |
| 2,083,315 | 6/1937 | Casso . | |
| 3,639,988 | 2/1972 | Impastato . | |
| 4,524,522 | 6/1985 | Perry | 33/11 |
| 5,386,654 | 2/1995 | Kroenke . | |
| 5,444,920 | 8/1995 | Nelson | 33/11 |

FOREIGN PATENT DOCUMENTS

| | | |
|---|---|---|
| 370338 | 4/1939 | Italy . |

*Primary Examiner*—Andrew Hirshfeld
*Attorney, Agent, or Firm*—Sixbey, Friedman, Leedom & Ferguson; Daivd S. Safran

[57] ABSTRACT

A sewing auxiliary tool used for the creation of garment patterns. The sewing auxiliary tool is constructed from a flat plate and has incorporated around its edges curves and straight line shapes. The geometric shapes of the sewing auxiliary tool's edge are used to create basic sewing curves; such as, the hip line, sleeve cap line, armhole line, neck line, and crotch line. Additionally, the sewing auxiliary tool can have both metric and English units of length measurement incorporated along the straight edge sections of the sewing auxiliary tool. The combination of the curves, straight lines, and length measurement capabilities provide the user with a single device with which to create garment patterns.

1 Claim, 4 Drawing Sheets

10

SEWING AUXILIARY TOOL

BACKGROUND OF THE INVENTION

1. Field of the Invention

This invention relates to a general purpose geometric form which can be used as a sewing auxiliary tool, a tailor's square, a carpenter's square, and by students in order to take measurements, trace curves, or to prepare special drawings. The invention more particularly relates to a sewing auxiliary tool which includes metric and English scales plus smoothly adds five basic sewing curves to its shape, namely: crotch line or curve, neck line or curve, armhole line or curve, hip line or curve, and sleeve cap line or curve.

2. Discussion of the Background

The garment industry is highly competitive and as such the elimination of time consuming steps during all phases of garment production is desired. To produce a garment, a pattern must first be made or modified. Currently, multiple tailor squares or templates are used to produce various curves and lines for dresses, shirts, and trousers. Some of the basic shapes that are repeatedly used are a straight edge, crotch line or curve, neck line or curve, armhole line or curve, hip line or curve, and sleeve cap line or curve. The use of so many geometric shapes to produce a garment consumes much of the garment maker's time. Further exacerbating the garment maker's problem of using so many geometric forms is the use of both English and metric geometric forms displaying measurements of length.

The garment maker's problem is just one example of a similar problem encountered by carpenters and students. Both carpenters and students employ multiple geometric shapes during the measurement of curves, tracing of curves, or during the preparation of special drawings. Thus, there is a need to incorporate into one instrument the basic sewing shapes which include curves and straight lines, and which incorporates both English and metric units of length measurement. Such a device is useful not just for garment workers but also for carpenters, and students.

SUMMARY OF THE INVENTION

It is an object of the invention to provide a tool which contains edges having multiple curves that can be used to create patterns or to measure preexisting patterns.

In one form of the invention the sewing auxiliary tool takes the form of a plate-shaped material having a long arm section and a short arm section. The long arm section has a straight edge, a free edge which is also straight, and a top edge which has a straight section and a curved section. The straight section of the top edge runs parallel to the straight edge. The short arm section is connected to the long arm section. The short arm section has a straight edge which intersects the straight edge of the long arm section at a right angle. Furthermore, the short arm section has a free end which also has a straight edge that intersects the previously mentioned straight edge of the short arm section at a right angle. The side edge of the short arm section has a curved shape. The side edge of the short arm section intersects the top edge of the long arm section in a continuously smooth manner.

In another form of the invention the sewing auxiliary tool takes the form of the object discussed above but further includes a metric scale of length which can be inscribed, placed, etc on one flat side of the sewing auxiliary tool near the straight edge sections of both the long and short arm sections. An English scale of length can similarly be inscribed, placed, etc on the reverse side of the sewing auxiliary tool near the straight edges of both the long and short arm sections.

In still another form of the invention the sewing auxiliary tool takes the form of a plate shaped material having a long arm section and a short arm section. The long arm section has a straight edge, a free edge which is straight, and a top edge which has at least one of a concave section and a convex section. The short arm section is connected to the long arm section. The short arm section has a straight edge, a free end edge that is straight and intersects the previously mentioned straight edge at a right angle. The short arm section has a side edge that has at least one of a concave section and a convex section. The side edge of the short arm section intersects the straight edge of the free end. Furthermore, the side edge curve of the short arm section intersects the top edge curve of the long arm section in a continuously smooth manner. One side of the sewing auxiliary tool has a metric scale of length which can be inscribed, placed, etc near each straight edge, and an English scale of length which can be inscribed, placed, etc near the straight edge of the other side of the sewing auxiliary tool.

Thus, Applicant's invention is superior to related devices. Applicant's invention provides a sewing auxiliary tool that combines multiple curves, straight edges, and measuring scales. The related devices fail to disclose the use of a tailor's scale employing multiple scales of length measurement, and which employ a straight edge section which runs parallel to the straight square edge section in conjunction with basic sewing curve geometries. Such structural features distinguish Applicant's invention, structurally and functionally, over the related devices.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
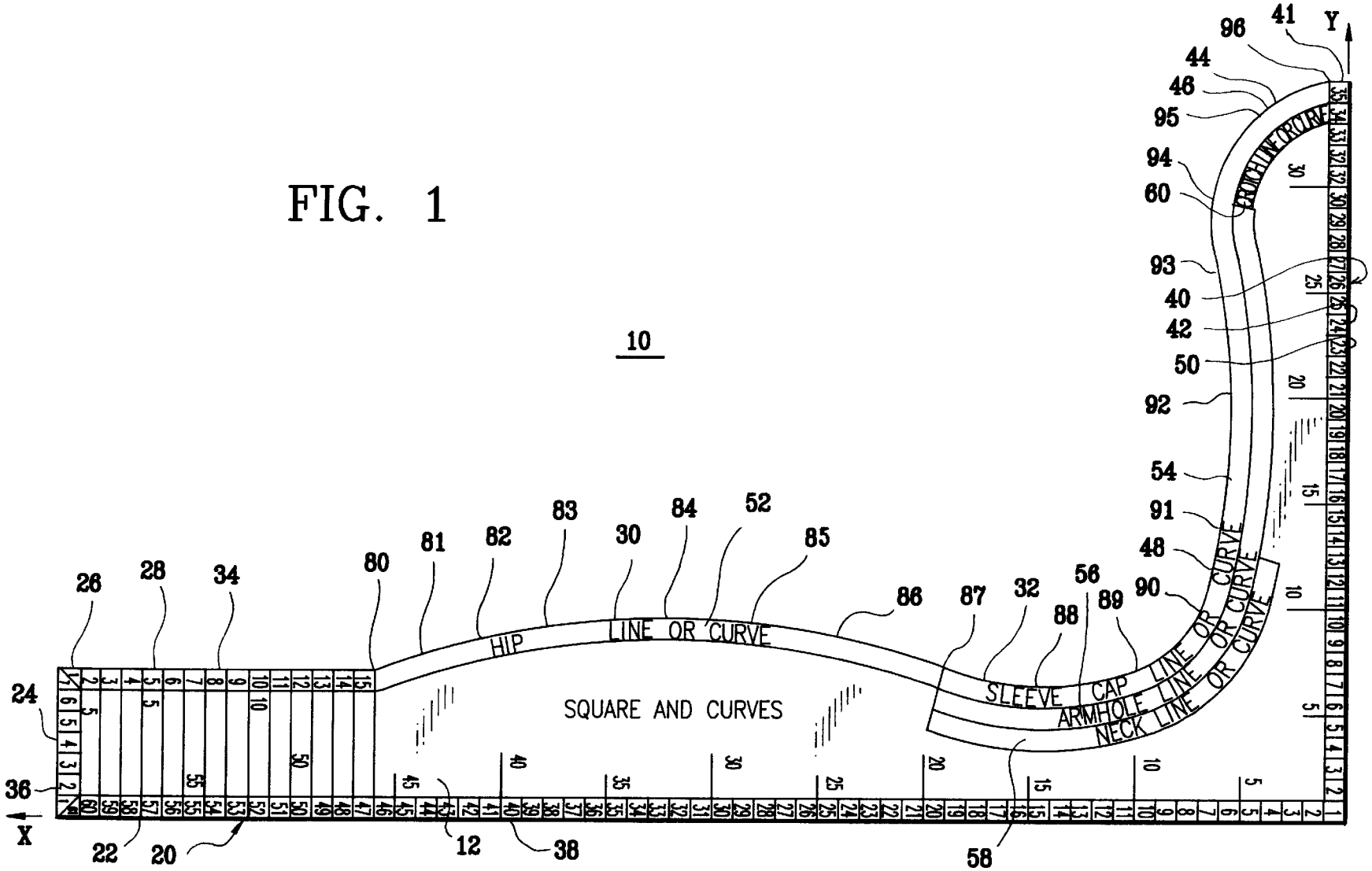
FIG. 1 is a top plan view of one side of the sewing auxiliary tool.
Figure 2:
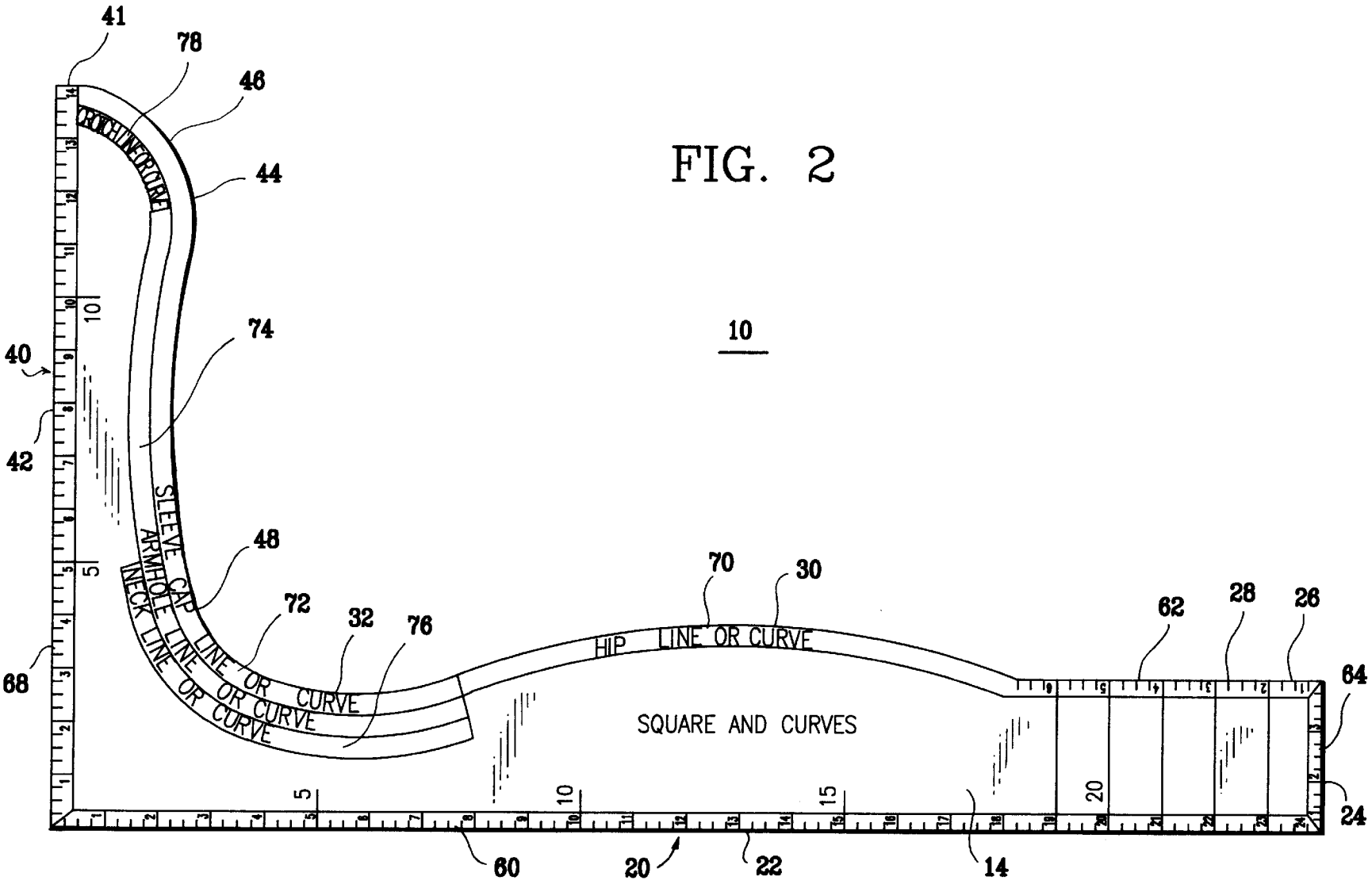
FIG. 2 is a top plan view of the other side of the sewing auxiliary tool.

Referring now to the drawings, wherein like reference numerals designate identical or corresponding parts throughout the several views, and more particularly to FIG. 1 thereof, a sewing auxiliary tool 10 is illustrated, which provides for the preparing of garment patterns or measurement of garment patterns using only this tool. The embodiment of this invention is displayed in FIGS. 1 and 2. FIG. 1 is a top plan view showing the obverse side 12 of the sewing auxiliary tool 10. FIG. 1 illustrates the long arm section 20 and the short arm section 40 of the sewing auxiliary tool 10. FIG. 1 also clearly illustrates the multiple sewing curves and the straight curve incorporated in the tool, the basic sewing curves are denoted by distinct segments on the obverse side 12 of the sewing auxiliary tool and defined as: a hip line or curve 52, a sleeve cap line or curve 54, an armhole line or curve 56, a crotch line or curve 60, a neck line or cure 58, and a straight line section 28. The obverse side 12 of the sewing auxiliary tool 10 can be imprinted, placed, etc near the edge of each straight line section with, for example, metric length units of measurement, such as centimeters as is shown for measuring scales 34, 36, 38, and 50. Furthermore, as can be seen in FIG. 1, the measuring scale 38 provided running along edge 22 increases from the short arm section 40 to the free edge 24, the measuring scale 34 running along edge 26 increases from free edge 24 in a direction parallel to edge 22 and the same is true for the measuring scales 66 and 62 on the reverse side 14, as shown in FIG. 2. This arrangement of the scales enable 34, 36, 38, enables the length of the scale 38 extending along the first straight edge 22 to be effectively increased by the length of the scale 34 extending along the second straight edge 28 since, for a piece of material that is longer than the first straight edge 22, it is possible to either the fold the material back over the free edge 24 and read off the length of the folded back section on the scale 34, or to mark the fabric at the free edge 24 and slide the tool downward, reading off the length that the tool has been slid at the scale 34. In either case, the length read off of the scale 34 can then be added to that of the scale 38 to obtain a measure of the total length.

FIG. 2 is a top plan view of the reverse side 14 of the sewing auxiliary tool 10. Other than being the reverse side 14 of the sewing auxiliary 10 displayed in FIG. 1, the reverse side 14 can be imprinted, placed, etc near each straight edge with, for example, English units of length measurement 62, 64, 66, and 68, instead of metric units of length measurement.

The units of length measurement utilized is based on design considerations depending upon the use of the tool.

Figure 3:
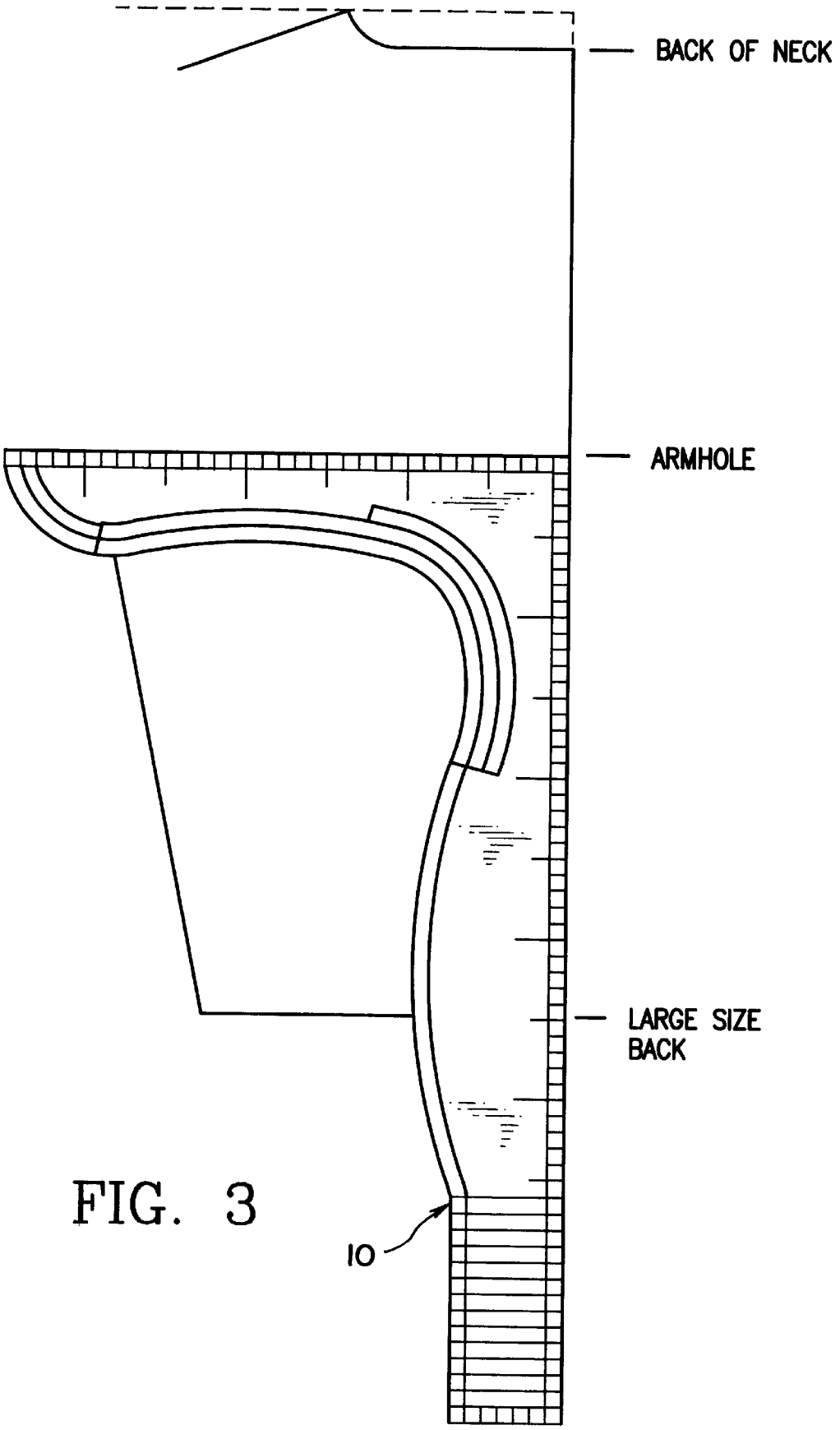
FIG. 3 is a top plan view of the auxiliary sewing tool being used to create a blouse pattern.

FIG. 3 is a top plan view of one example of implementation of the tool of the invention in which the sewing auxiliary tool 10 is used to create a garment pattern.

Figure 4:
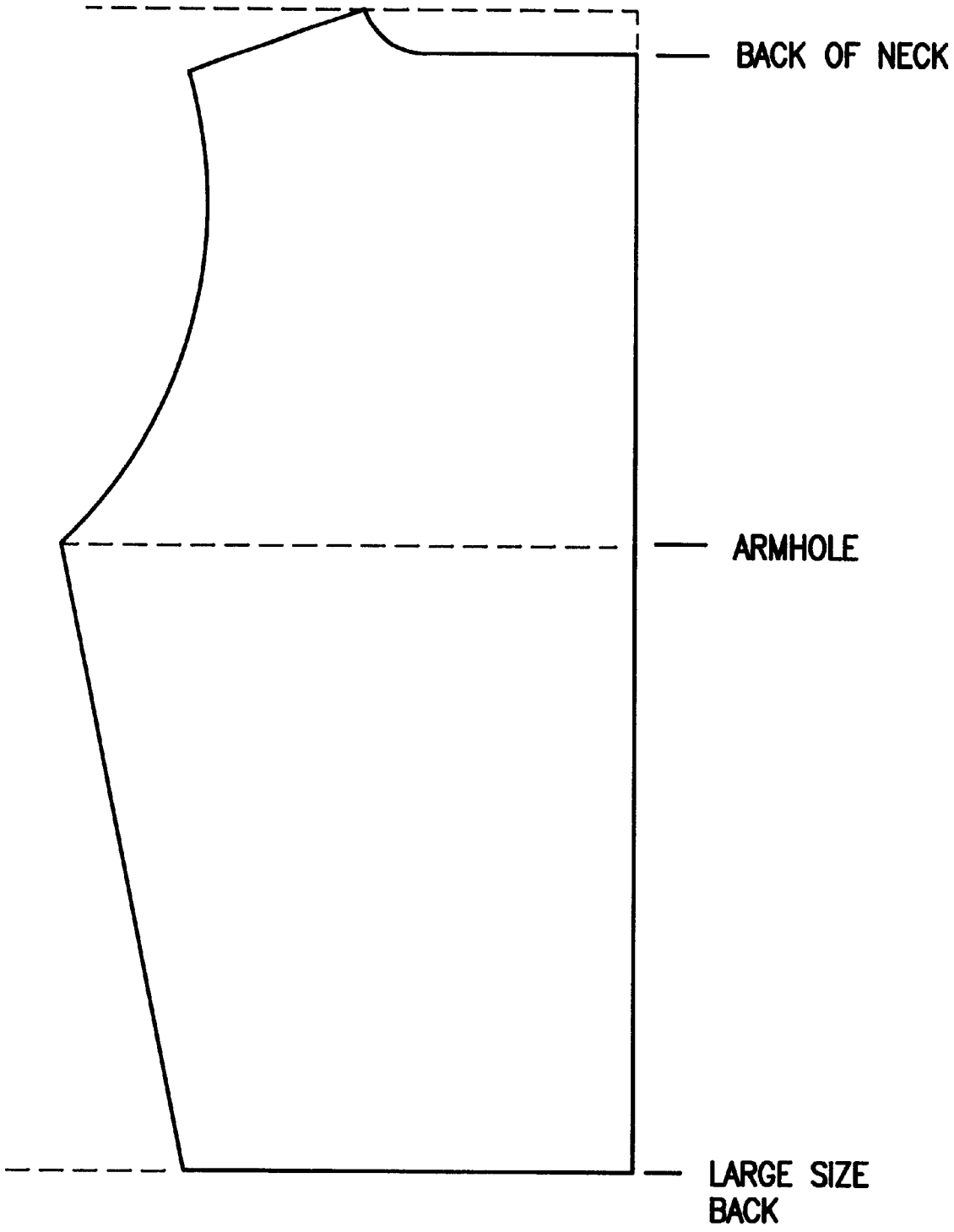
FIG. 4 is a top plan view of a blouse pattern created using the sewing auxiliary tool.

FIG. 4 is a top plan view of a garment pattern, namely one half of a blouse pattern, created through the use of the auxiliary sewing tool 10.

The sewing auxiliary tool 10 has the long arm section 20 and the short arm section 40. The sewing auxiliary tool can be made from a plate like material, preferably wood, metal, plastic, or etc. As shown in FIG. 1 which illustrates the obverse side 12 of the sewing auxiliary tool 10, the long arm section 20 has a straight edge 22, a free edge 24 and a top edge 26. The top edge 26 has a straight line section 28, a convex section 30, and a concave section 32. The straight line section 28 intersects the convex section 30, and the convex section 30 intersects the concave section 32 at an approximately zero degree angle of intersection. The straight line section 28 of the top edge 26 intersects the free edge 24 at an approximately right angle. The free edge 24 also intersects the straight edge 22 at an approximately right angle.

The short arm section 40 has a straight edge 42, a free end 41, and a side edge 44. The straight edge 42 of the short arm section 40 intersects the straight edge 22 of the long arm section 20 at an approximately right angle. The free edge 41 intersects the straight edge 42 of the short arm section 40 at an approximately right angle. The side edge 44 has a convex section 46, and a concave section 48. The convex section 46 of the side edge 44 intersects the free edge 41. The convex section 46 intersects the concave section 48 at an approximately zero degree angle of intersection. Additionally, the concave section 48 of the short arm section 40 intersects the concave section 32 of the long arm section 20 at an approximately zero degree of intersection.

The smooth curve that combines the five basic sewing curves is constructed by plotting out coordinate locations and drawing a smooth, continuous line through those locations. FIG. 1 illustrates an X-Y rectangular coordinate system. The origin of the coordinate system is at the intersection of the short and long arm sections 20, 40 of the sewing auxiliary tool 10. The coordinate locations that comprise the smooth continuous curve are called design points and are denoted as design points 80–96. Expressed in an X, Y coordinate location in units of centimeters the position of the design points based on design considerations can be as follows:

| | | |
|---|---|---|
| Design point 80 | 46.00 cm, | 7.00 cm; |
| Design point 81 | 44.00 cm, | 7.50 cm; |
| Design point 82 | 41.00 cm, | 8.50 cm; |
| Design point 83 | 38.00 cm, | 9.00 cm; |
| Design point 84 | 33.00 cm, | 9.50 cm; |
| Design point 85 | 28.00 cm, | 9.00 cm; |
| Design point 86 | 24.00 cm, | 8.50 cm; |
| Design point 87 | 19.00 cm, | 7.50 cm; |
| Design point 88 | 14.50 cm, | 7.00 cm; |
| Design point 89 | 10.50 cm, | 8.50 cm; |
| Design point 90 | 8.50 cm, | 10.50 cm; |
| Design point 91 | 7.00 cm, | 14.00 cm; |
| Design point 92 | 6.50 cm, | 20.50 cm; |
| Design point 93 | 7.00 cm, | 26.00 cm; |
| Design point 94 | 6.50 cm, | 29.50 cm; |
| Design point 95 | 4.00 cm, | 33.00 cm; and |
| Design point 96 | 1.00 cm, | 35.00 cm. |

The obverse side 12 of the sewing auxiliary tool 10 associates a basic sewing curve with a curved surface region of the sewing auxiliary tool 10. The "hip line or curve" 52 is imprinted, placed, etc near the top edge 26 of the long arm section 20. The hip line or curve 52 region extends from design point 80 to approximately design point 87. The "sleeve cap line or curve" 54 is imprinted, placed, etc on the flat surface of the sewing auxiliary tool 10 near top edge 26 of the long arm section 20 and the side edge 44 of the short arm section 40. The sleeve cap line or curve 54 region extends from approximately design point 87 to approximately design point 96. The "armhole line or curve" 56 is imprinted, placed, etc on the flat surface of the sewing auxiliary tool 10 near the top edge 26 of the long arm section 20 and the side edge 44 of the short arm section 40. The armhole line or curve 56 region extends from approximately the location of design point 87 to the location of design point 94. The "neck line or curve" 58 is imprinted, placed, etc on the flat surface of the sewing auxiliary tool 10 near the top edge 26 of the long arm section 20 and the side edge 44 of the short arm section 40. The neck line or curve 58 region extends from approximately the location of design point 87 to the location of design point 91. The "crotch line or curve" 60 is imprinted, placed, etc on the flat surface of the sewing auxiliary tool 10 near the side edge 44 of the short arm section 40. The crotch line or curve 60 region extends from approximately the location of design point 94 and extends approximately to the location of design point 96.

As shown in FIG. 1, the obverse side 12 of the sewing auxiliary tool 10 has a metric unit of length measurement imprinted, placed, etc on the flat surface of the sewing auxiliary tool 10 near the straight section 28 of the top edge 26, the free edge 24 of the long arm section 20, the straight edge 22 of the long arm section 20, and the straight edge 42 of the short arm section 40. The metric unit of the length measurement shown in FIG. 1 is that of the centimeter.

FIG. 2 shows the reverse side 14 of the sewing auxiliary tool 10. The reverse side 14 is similar to the obverse side 12 of the sewing auxiliary tool 10 in that there is a hip line or curve region 70, a sleeve cap line or curve region 72, an armhole line or curve region 74, a neck line or curve region 76, and a crotch line or curve region 78. The difference between the obverse side 12 and the reverse side 14 is the use of different systems of length measurement. The obverse side 12 employs the metric system, and the reverse side 14 employs the English system. An English unit of length measurement is imprinted, placed, etc on the flat surface of the sewing auxiliary tool 10 near the straight section 28 of the top edge 26, the free edge 24 of the long arm section 20, the straight edge 22 of the long arm section 20, and the straight edge 42 of the short arm section 40.

The sewing auxiliary tool 10 can be employed by a user to trace sewing patterns during the preparation of blouses, dresses, trousers, and other garments. The user of the sewing auxiliary tool 10 has at his or her disposal five basic sewing curves, a straight section parallel to a straight edge, and further includes metric and English scales of length measurement. The user employs the sewing auxiliary tool 10 by moving it to the right, left, up, and down or in any direction that the user wants and at an infinite number of angles. FIG. 3 shows the sewing auxiliary tool 10 in use during the production of a blouse pattern. FIG. 4 shows the finished symmetrical one half piece of a blouse pattern created using the sewing auxiliary tool 10. Thus, any one acquainted with the tailoring art may design patterns with facility and ease.

The sewing auxiliary tool 10 can also be used by carpenters and students in order to take measurements, trace curves, or prepare special drawings.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A sewing auxiliary tool comprising:

a long arm section having a first means for tracing basic sewing curves;

a short arm section connected to said long arm section, said short arm section having a second means for tracing basic sewing curves; and each of said long arm and short arm sections having a straight edge for measuring length, the straight edge of the long arm section intersecting the straight edge of the short arm section at a right angle;

wherein said long arm section has a length of substantially 61 cm (24"); and wherein said short arm section has a length of substantially 35 cm (13⅝"); and wherein said sewing curves comprise hip, sleeve, arm hole, neck, and crotch curves combined in the form of a smooth, continuous curve running through points which, expressed in an x, y coordinates system having its origin at the intersection of the straight edges of the short and long arm sections and x and y axes defined by the straight edges of the long and short arm sections, respectively, having in sequence at least the following x, y coordinates measured in centimeters: 1.0, 35.0; 4, 33; 6.5, 29.5; 7.0, 26.0; 6.5, 20.5; 7.0, 14.0; 8.5, 10.5; 10.5, 8.5; 14.5, 7.0; 19.0, 7.5; 24.0, 8.5; 28.0, 9.0; 33.0, 9.5; 38.0, 9.0; 41.0, 8.5; 44.0; 7.5; and 46.0, 7.0.

* * * * *